US010236642B2

(12) United States Patent
Ma et al.

(10) Patent No.: US 10,236,642 B2
(45) **Date of Patent: *Mar. 19, 2019**

(54) CONNECTOR HAVING PCB WITH THEREOF LED COMMUNICATIVELY COUPLED WITH IDENTIFICATION RING

(71) Applicant: FOXCONN INTERCONNECT TECHNOLOGY LIMITED, Grand Cayman (KY)

(72) Inventors: Er-Dong Ma, Kunshan (CN); Xiao-Bo Du, Kunshan (CN); Peng Chen, Kunshan (CN); Chun-Ming Yu, Kunshan (CN); Guo-Hua Zhang, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

This patent is subject to a terminal disclaimer.

(21) Appl. No.: 15/807,513

(22) Filed: Nov. 8, 2017

(65) Prior Publication Data

US 2018/0131141 A1 May 10, 2018

(30) Foreign Application Priority Data

Nov. 8, 2016 (CN) ..... 2016 2 1201551 U

(51) Int. Cl.

| | |
|---|---|
| ***H01R 13/46*** | (2006.01) |
| ***H01R 13/66*** | (2006.01) |
| ***H01R 13/717*** | (2006.01) |

(52) U.S. Cl.
CPC ..... *H01R 13/7175* (2013.01); *H01R 13/465* (2013.01); *H01R 13/7172* (2013.01); *H01R 13/6658* (2013.01)

(58) Field of Classification Search
CPC ..... H01R 13/7175; H01R 13/717; H01R 13/7172; H01R 13/465; H01R 13/6658
(Continued)

(56) References Cited

U.S. PATENT DOCUMENTS 6,056,594 A * 5/2000 Ching ..... H01R 13/465 439/541.5
6,257,906 B1 * 7/2001 Price ..... H01R 13/60 439/131
(Continued)

FOREIGN PATENT DOCUMENTS

TW 506674 10/2002
TW 568434 12/2003
(Continued)

*Primary Examiner* — Gary F Paumen
(74) *Attorney, Agent, or Firm* — Wei Te Chung; Ming Chieh Chang

(57) ABSTRACT

An electrical connector includes an insulative housing having a main body defining a plurality of mating cavities each coupled with an LED located right behind the mating cavity. A plurality of contacts are disposed in the housing corresponding to each of the mating cavities. A translucent color ring is assembled upon a front face of the main body of the housing in front of each mating cavity. A printed circuit board is vertically attached upon a rear side of the main body with a terminal module assembled on the bottom edge. A plurality of LEDs are mounted upon the printed circuit board wherein all LEDs are electrically connected to the terminal module having connecting legs.

20 Claims, 7 Drawing Sheets

(58) Field of Classification Search
USPC ..... 439/490, 910, 541.5
See application file for complete search history.

(56) References Cited

U.S. PATENT DOCUMENTS

| | | | | |
|---|---|---|---|---|
| 6,508,665 | B1 | 1/2003 | Yeh | |
| 6,776,651 | B1 * | 8/2004 | Liu | H01R 13/641 439/490 |
| 6,910,917 | B2 * | 6/2005 | Chen | H01R 13/518 439/541.5 |
| 6,997,742 | B1 * | 2/2006 | Tung | H01R 13/514 439/101 |
| 7,029,329 | B1 * | 4/2006 | Huang | H01R 13/514 439/541.5 |
| 2004/0248464 | A1 * | 12/2004 | Xue | H01R 12/716 439/541.5 |
| 2006/0256556 | A1 * | 11/2006 | Huang | H01R 13/717 362/249.01 |
| 2007/0155223 | A1 * | 7/2007 | Huang | H01R 13/717 439/490 |
| 2010/0124842 | A1 * | 5/2010 | Bu | H01R 13/518 439/541.5 |
| 2013/0017715 | A1 * | 1/2013 | Laarhoven | H01R 13/717 439/490 |
| 2014/0213100 | A1 * | 7/2014 | Xuan | H01R 13/7175 439/490 |
| 2018/0131140 | A1 * | 5/2018 | Du | H01R 13/7175 |

FOREIGN PATENT DOCUMENTS

| | | |
|---|---|---|
| TW | M258464 | 3/2005 |
| TW | M391214 | 10/2010 |
| TW | M254755 | 1/2015 |

* cited by examiner

CONNECTOR HAVING PCB WITH THEREOF LED COMMUNICATIVELY COUPLED WITH IDENTIFICATION RING

BACKGROUND OF THE DISCLOSURE

1. Field of the Disclosure

The invention is related to an electrical connector, and particularly to the electrical connector equipped with identification light devices for plural mating ports. The instant application relates to the copending application filed on the same day with the same applicant and titled with "CONNECTOR WITH FRONT SIDE IDENTIFICATION RING COMMUNICATIVELY COUPLED WITH REAR SIDE LED".

2. Description of Related Arts

Taiwan Utility Patent No. M254755 discloses an electrical connector equipped with differently colored caps for identification use. Anyhow, when the circumstance is relatively dark, it is uneasy to correctly perceive the correct color for identification. Taiwan Utility Patent No. M391214 discloses an electrical connector equipped with the differently colored LEDs (Light Emitting Diodes) for the dark use. Notably, such LEDs are assembled upon the front face of the housing, thus somewhat complicating the manufacturing process and the circuit paths on the printed circuit board. Taiwan Utility Patent No. 568434 discloses the LEDs mounted upon a vertical printed circuit board behind the mating cavities and transmitting the light through a transparent contact-retaining base on which the contacts are secured. Anyhow, using the transparent base in the mating cavity to hold the corresponding contacts is essentially not economic and practical.

It is desired to provide an electrical connector with the LEDs around the rear side of the housing for facilitating the manufacturing process and simplifying the circuit layout on the printed circuit board.

SUMMARY OF THE DISCLOSURE

To achieve the above desire, an electrical connector includes an insulative housing having a main body defining a plurality of mating cavities each coupled with an LED located right behind the mating cavity. A plurality of contacts are disposed in the housing corresponding to each of the mating cavities. A translucent color ring is assembled upon a front face of the main body of the housing in front of each mating cavity. A printed circuit board is vertically attached upon a rear side of the main body with a terminal module assembled on the bottom edge. A plurality of LEDs are mounted upon the printed circuit board wherein all LEDs are electrically connected to the terminal module having connecting legs. An additional feature is to have all LEDs connect to the different positive connecting legs while sharing a same negative connecting leg. Another feature of the invention is to provide a specific pattern for a plurality of LEDs mounted upon the printed circuit board for economic layout use. A further feature of the invention is to provide the translucent mating ring extending along the front-to-back direction to directly intimately receive the complementary plug connector axially with a distance.

DETAILED DESCRIPTION OF THE PREFERRED EMBODIMENT

Figure 1:
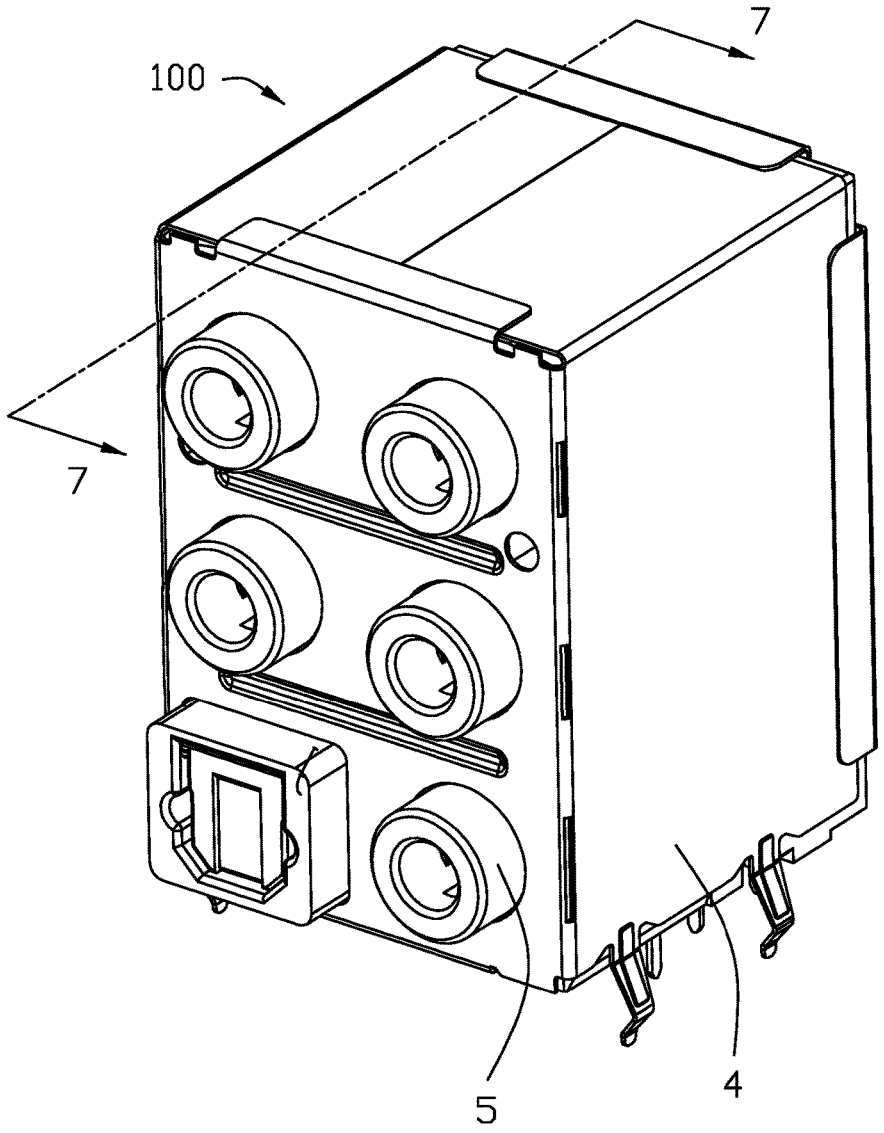
FIG. 1 is a perspective view of an electrical connector with according to the invention.
Figure 2:
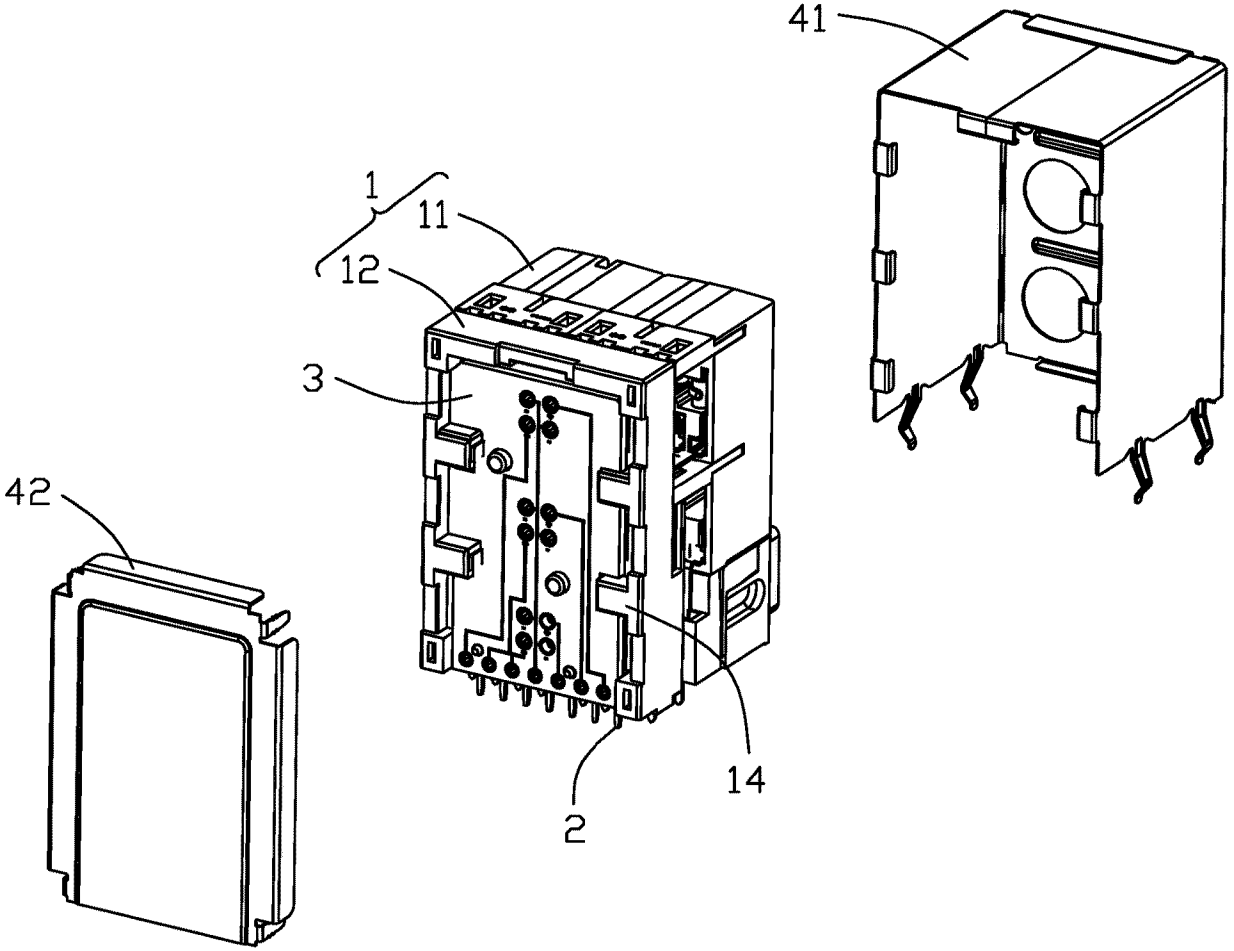
FIG. 2 is a rear exploded perspective view of the electrical connector of FIG. 1.
Figure 3:
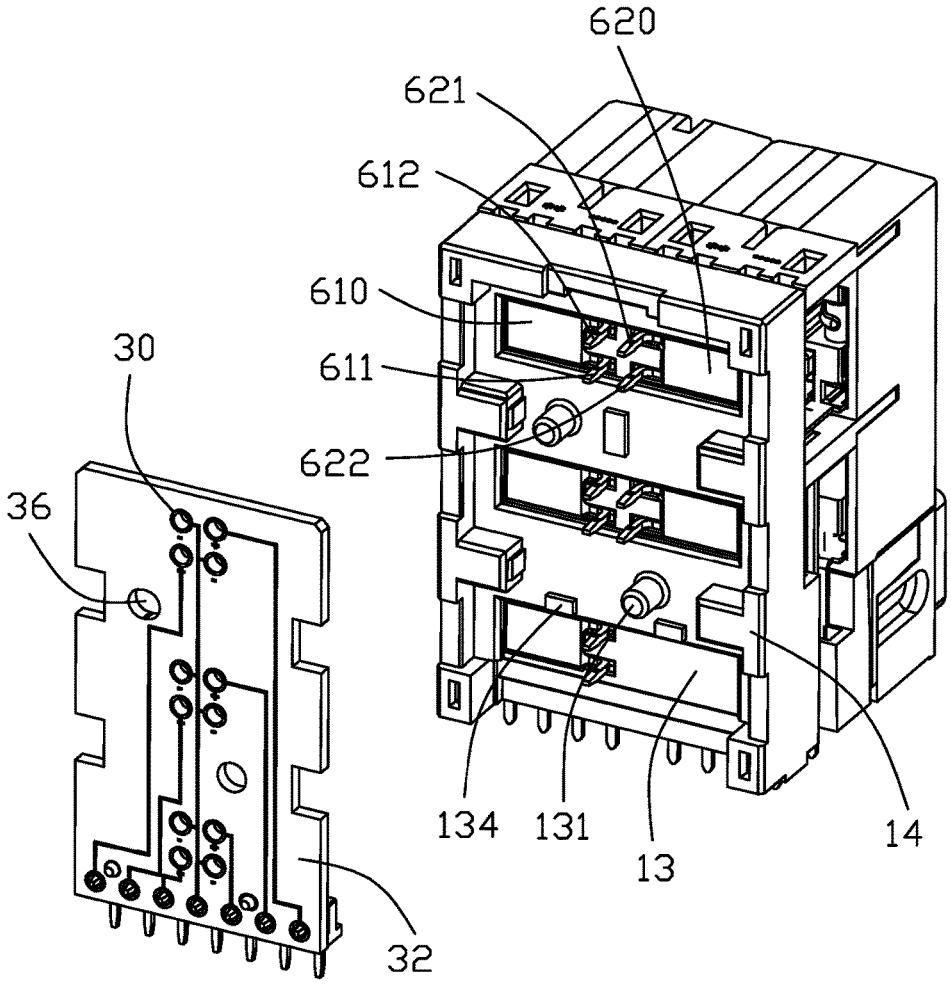
FIG. 3 is a further rear exploded perspective view of the electrical connector of FIG. 2 without showing the shield.
Figure 4:
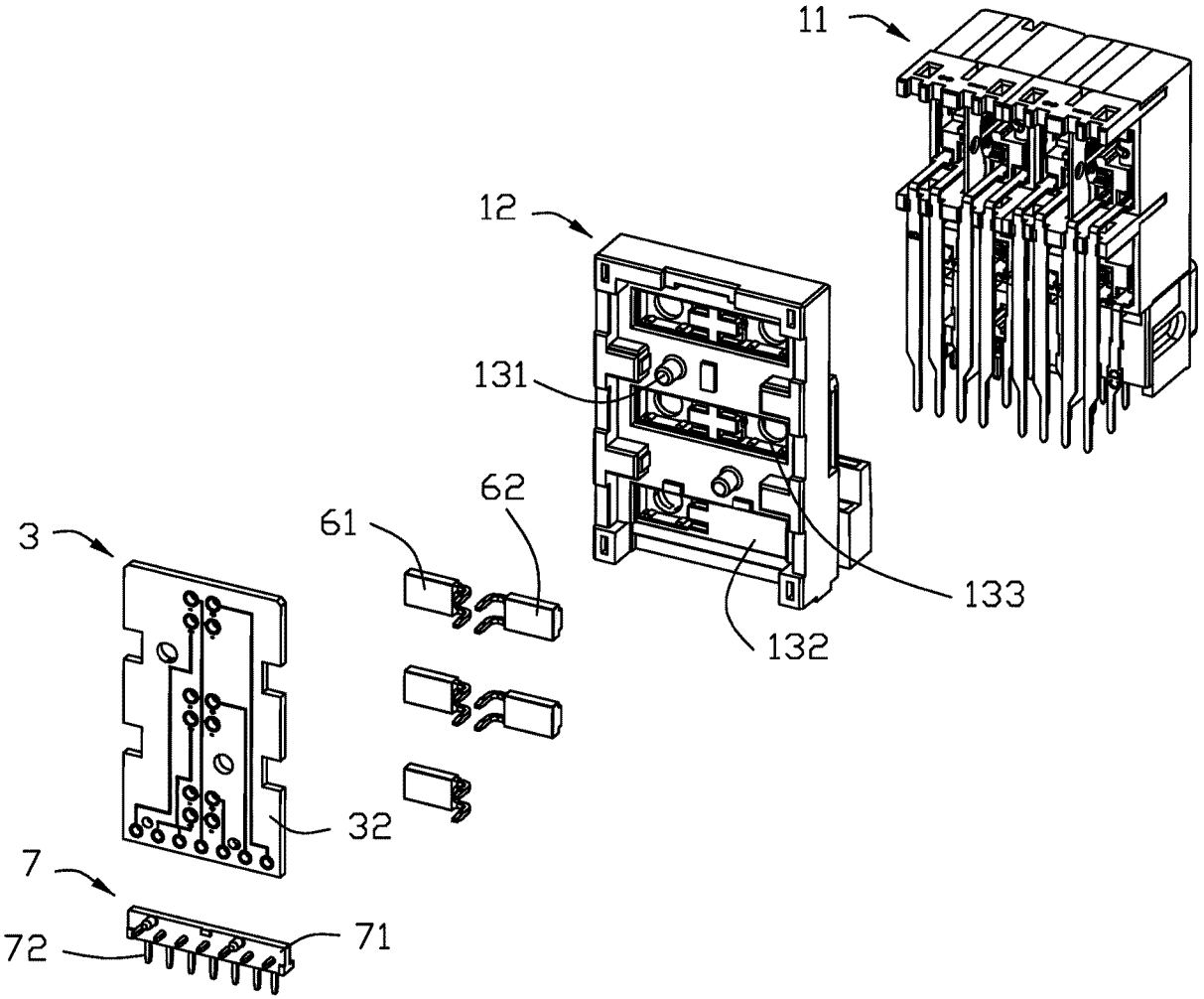
FIG. 4 is a further rear exploded perspective view of the electrical connector of FIG. 3 wherein the LEDs are retained in the spacer.
Figure 5:
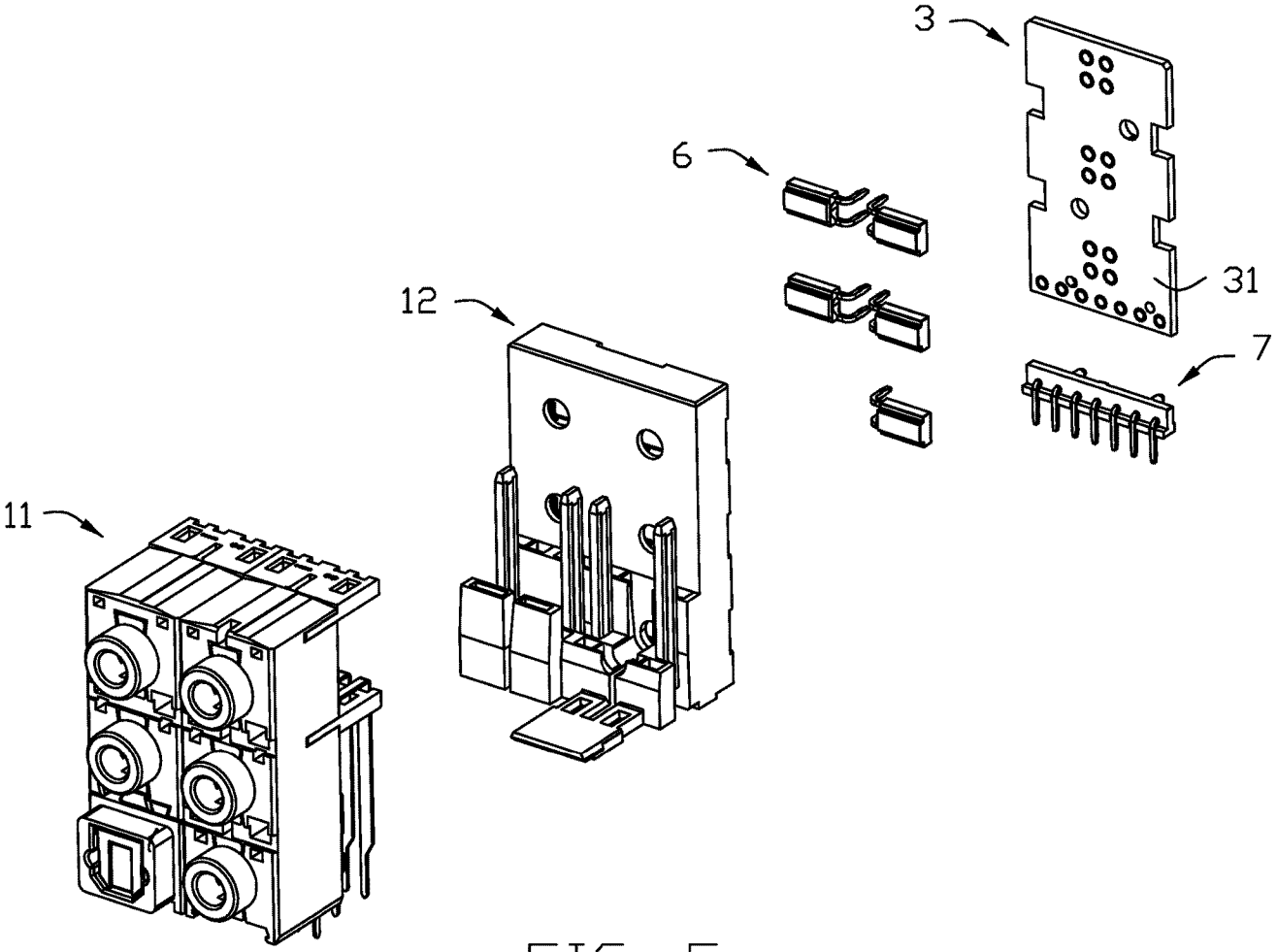
FIG. 5 is a front exploded perspective view of the electrical connector of FIG. 4.
Figure 6:
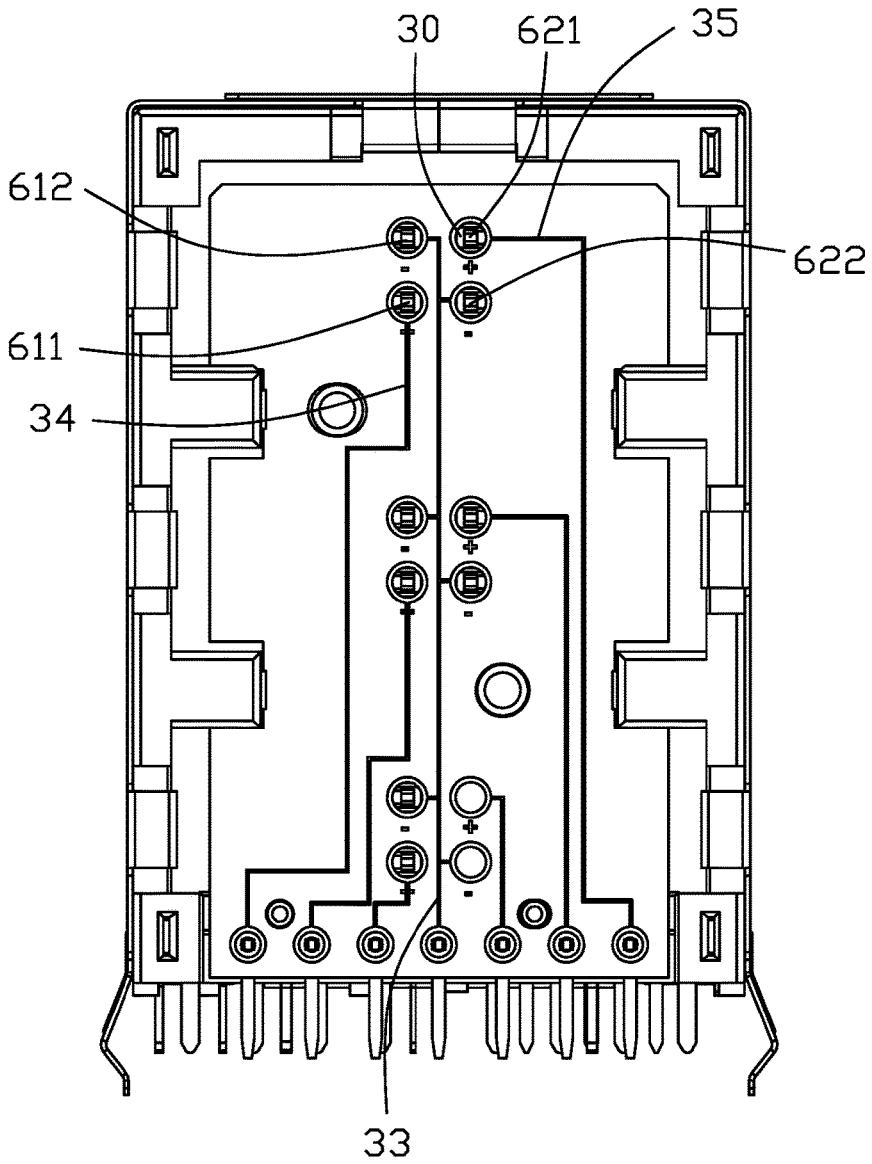
FIG. 6 is a rear view of the electrical connector of FIG. 2 without showing the rear cover.
Figure 7:
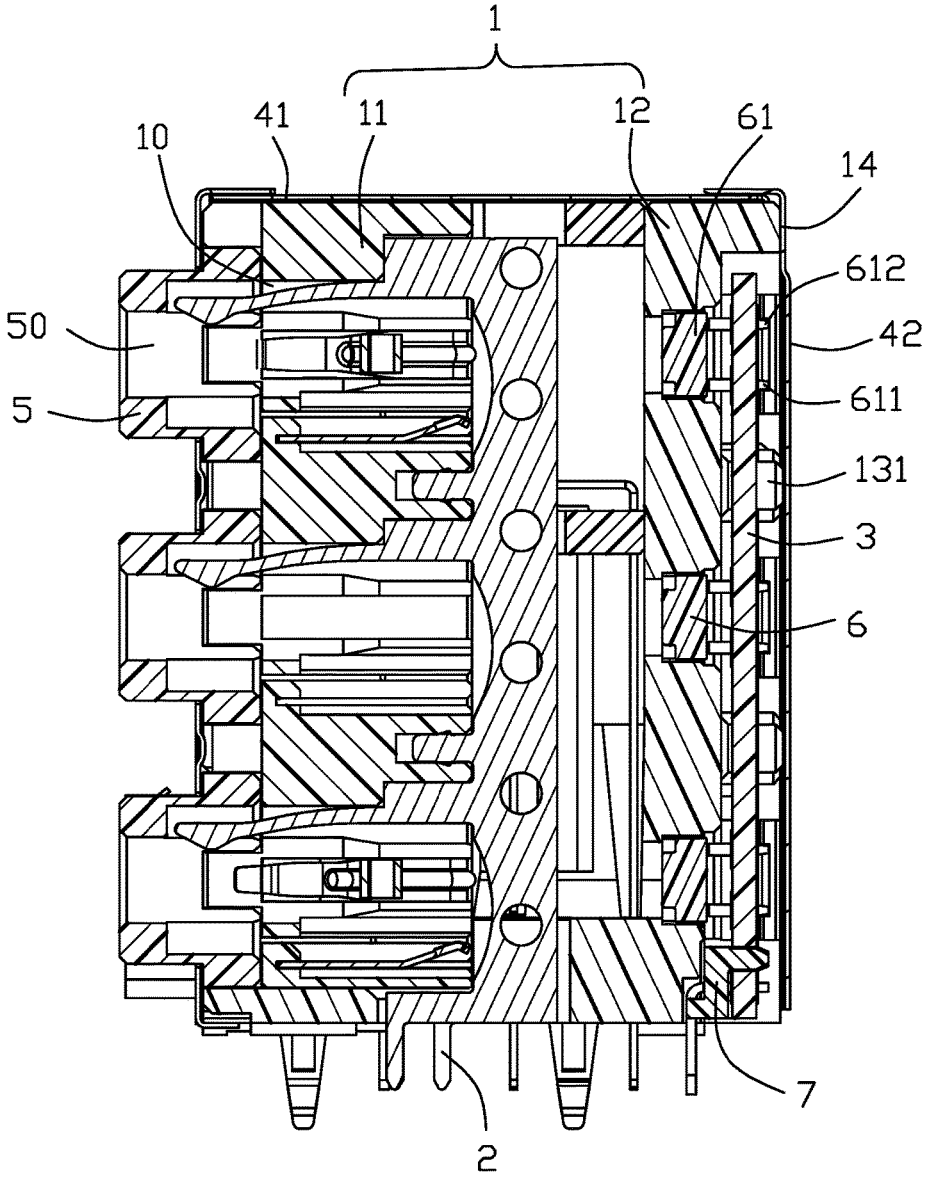
FIG. 7 is a cross-sectional view of the electrical connector of FIG. 1 along line A-A.

Reference will now be made in detail to the embodiments of the present disclosure. Referring to FIGS. 1-7, an electrical card connector 100 includes an insulative housing 1 defining a plurality of mating cavities 10, a plurality of contacts 2 disposed in the housing 1 around each mating cavity 10, a plurality of mating rings or parts 5 attached upon the front face of the housing 1 and respectively aligned in front of the corresponding mating cavities 10, a plurality of LEDs or light devices 6 located behind the corresponding mating ring 5, a printed circuit board 3 which is located behind the housing 1 and the LEDs are mounted upon, and a metallic shield 4 covering the housing 1. The mating ring 5 forms a mating hole 50 rearwardly communicating with the corresponding mating cavity 10 and forwardly communicating with an exterior in the front-to-back direction for allowing a corresponding plug connector to be inserted thereinto to reach the corresponding mating cavity 10. The mating ring 5 is essentially translucent/transparent and differently colored. In this embodiment, the mating ring 5 directly encloses the front end of the corresponding contact 2. The housing 1 includes a main body 11 forming the mating cavities 10 therein, and a holder 12 retaining the rear part of the contacts 2 thereto. The LEDs 6 and the printed circuit board 3 are received within the holder 12. The shield 4 includes a front shell 41 enclosing the main body 11, and a rear shell 42 covering the printed circuit board 3.

When no plug is inserted into the mating cavity 10 through the mating ring 5, the light may forwardly spread to be viewable through the colored mating ring 5 for efficient identification. When the plug is inserted into the mating cavity 10 through the mating ring 5, some light is still escape from the gap between the plug and the housing 1 so as to be viewable in front of the connector 100 for the identification purpose notably.

The housing 1 includes opposite front face (not labeled) and rear face 14 with a receiving cavity 13 therein. The LEDs 6 and the printed circuit board 3 are both received within the receiving cavity 13. The receiving cavity 13 includes the first receiving space 132 extending through the rear face 14, and a second receiving space 133 further forwardly/inwardly recessed from the first receiving space 132. The first LEDs 61 and the second LED 62 are side by side received within the corresponding second receiving spaces 133 while the printed circuit board 3 is received within the first receiving space 132. The first LED and the second LED are aligned with the corresponding mating cavities 10 in the front-to-back direction. Each of the LEDs 6 has a same structure wherein the first (side) LED has a first main portion 610, the first positive leg 611 and the first negative leg 612 and the second (side) LED has a second main portion 620, the second positive leg 621 and the second positive leg 622. In this embodiment, the first positive leg 611 and the first negative leg 612 are spaced from each other in the vertical direction perpendicular to the front-to-back direction. Because the first LED 61 and the second LED 62 are spaced from each other in the transverse direction perpendicular to both the front-to-back direction and the vertical direction, the first positive leg 611 and the second positive leg 621 are respective located by two opposite sides of a vertical center line of the connector 100.

The printed circuit board 3 includes opposite front face 31 and rear face 32 with positioning holes 36 extending therethrough in the front-to-back direction. Correspondingly, the housing 1 includes the positioning posts 131 extending rearwardly through the corresponding positioning holes 36, respectively. In this embodiment, the posts 131 extend slightly beyond the rear face 32 and abut against the rear cover 42. In this embodiment, the posts 131 are formed on the holder 12, the receiving cavity 13 is formed in the holder 12, and the contact 2 is retained to the holder 12. The second receiving space 133 extends through the front face of the holder 12 in alignment with the corresponding mating cavity 10 and mating hole 50 in the front-to-back direction. The terminal module 7 includes the insulator 71 and the connecting legs 72 integrally formed with each other.

The receiving cavity 13 forms abutment blocks 134 to contact the front face 31 of the printed circuit board 31.

The printed circuit board 3 has a plurality of through holes 30 extending through the front face 31 and the rear face 32 to receive the corresponding first positive legs 611, first negative legs 612, second positive legs 621 and second negative legs 622. A plurality of first positive lines 34 respectively link the first positive legs 611 to the corresponding connecting legs 72, and a plurality of second positive lines 35 respectively link second positive legs 621 to the corresponding connecting legs 72 while only a common single negative line 33 simultaneously link both the first negative legs 612 and the second negative legs 622 to a single connecting leg 72. In this embodiment, the through holes 30 are arranged with two rows in the vertical direction to respectively correspond to the first (side) LEDs 61 and the second (side) LEDs 62, and the common single negative line 33 is located between these two rows so the first LEDs 61 and the second LEDs 62 are respectively located by two sides of the common single negative line 33. On the other hand, even though the first LED 61 and the second LED 62 are paired to be side by side aligned with each other in the transverse direction, the first positive leg 611 is offset from the second positive leg 621 in the vertical direction, and the second negative leg 612 and the second negative leg 622 are as well.

While a preferred embodiment in accordance with the present disclosure has been shown and described, equivalent modifications and changes known to persons skilled in the art according to the spirit of the present disclosure are considered within the scope of the present disclosure as described in the appended claims. For example, the LED may not be located right behind the mating cavity in the front-to-back direction, and the main body may, beside the mating cavity, form the additional through hole along the front-to-back direction in alignment with the LED in the front-to-back direction as long as such a through hole is located behind the mating ring in the front-to-back direction. One feature of the mating ring of the invention is to axially extend along the front-to-back direction and communicate with the mating cavity in the front-to-back direction so as to allow the plug connector to be received within the axially extending mating hole, compared with the traditional ones which essentially use the housing solely to form the corresponding mating hole/cavity for receiving the plug connector while the traditional colored mating ring only surrounds the tubular mating port which is formed by the housing to receive the plug connector.

What is claimed is:

1. An electrical connector comprising:

an insulative housing;

a plurality of mating cavities enclosed within the housing and forwardly communicating with an exterior along a front-to-back direction for receiving a plug;

a plurality of contacts disposed in the housing; and a plurality of LEDs (Light Emitting Diodes) mounted upon a printed circuit board and positioned on a rear side of the housing and respectively aligned with the mating cavities in said front-to-back direction so as to allow light to be forwardly exposed to an exterior via the corresponding mating cavities in said front-to-back direction.

2. The electrical connector as claimed in claim 1, wherein a plurality of mating parts are assembled upon a front face of the housing and respectively essentially aligned with the corresponding mating cavities, and each of said mating part is translucent or transparent.

3. The electrical connector as claimed in claim 2, wherein said mating parts are differently colored.

4. The electrical connector as claimed in claim 2, wherein each mating part defines a mating hole rearwardly communicating with the corresponding mating cavity in the front-to-back direction.

5. The electrical connector as claimed in claim 1, wherein said housing includes a front main body and a rear holder, and the printed circuit board is located essentially behind the holder.

6. The electrical connector as claimed in claim 5, wherein the holder forms a receiving cavity to receive the LEDs therein.

7. The electrical connector as claimed in claim 5, wherein each of said contacts is retained by the holder.

8. The electrical connector as claimed in claim 1, wherein each of the LEDs includes a main part with a positive leg and a negative leg, and the printed circuit board includes a plurality of connecting legs around a bottom edge, and further defines a plurality of positive lines connecting the corresponding positive legs to the different connecting legs while a common single negative line connecting the corresponding negative legs to a same single connecting leg.

9. The electrical connector as claimed in claim 8, wherein the LEDs are arranged to be paired along a vertical direction perpendicular to the front-to-back direction, and each pair are spaced from each other in a transverse direction perpendicular to both the front-to-back direction and the vertical direction so that the positive legs and negative legs are alternately arranged with each other in two rows along the vertical direction, and the common single negative line is essentially located between said two rows.

10. The electrical connector as claimed in claim 9, wherein said common single negative line is aligned with a center line of the housing.

11. An electrical connector comprising:

an insulative housing;

a plurality of mating cavities enclosed within the housing for receiving corresponding plugs therein;

a plurality of contacts disposed in the housing;

a plurality of mating rings mounted upon a front face of the housing and defining a mating hole communicatively aligned with the corresponding mating cavities in a front-to-back direction, respectively, said mating ring being translucent or transparent; and a plurality of LEDs (Light Emitting Diodes) positioned on a rear side of the housing and respectively located behind and aligned with the mating cavities in the front-to-back direction; wherein the front end of the contact extends forwardly beyond the front face of the housing and is circumferentially directly enclosed within the mating ring, and light derived from the corresponding LEDs is emitted to the corresponding mating ring for viewable identification.

12. The electrical connector as claimed in claim 11, wherein the light is emitted through the corresponding mating cavity and mating hole toward the corresponding mating ring.

13. The electrical connector as claimed in claim 11, wherein the housing includes a front main body and a rear holder, and said mating cavities are formed in the main body while said LEDs are received with corresponding receiving spaces in the holder.

14. The electrical connector as claimed in claim 13, further including, on a rear side of the rear holder, a printed circuit board on which positive legs and negative legs of said LEDs are mounted.

15. The electrical connector as claimed in claim 14 wherein the printed circuit board includes a plurality of connecting legs around a bottom edge, and further defines a plurality of positive lines connecting the corresponding positive legs to the different connecting legs while a common single negative line connecting the corresponding negative legs to a same single connecting leg.

16. The electrical connector as claimed in claim 15, wherein the LEDs are arranged to be paired along a vertical direction perpendicular to the front-to-back direction, and each pair are spaced from each other in a transverse direction perpendicular to both the front-to-back direction and the vertical direction so that the positive legs and negative legs are alternately arranged with each other in two rows along the vertical direction, and the common single negative line is essentially located between said two rows.

17. An electrical connector comprising:

an insulative housing;

a plurality of mating cavities enclosed within the housing and forwardly communicating with an exterior in a front-to-back direction for receiving corresponding plugs therein;

a plurality of contacts disposed in the housing;

a plurality of mating parts mounted upon a front face of the housing and forming corresponding mating holes in alignment with the corresponding mating cavities in the front-to-back direction, respectively, said mating part being translucent or transparent; and a plurality of LEDs (Light Emitting Diodes) mounted upon a printed circuit board and aligned with the corresponding mating cavities along the front-to-back direction, respectively; wherein light derived from the LED is forwardly transmitted toward the corresponding mating part in said front-to-back direction; wherein the mating part extends along said front-to-back direction and communicates with the corresponding mating cavity along said front-to-back direction, and light derived from the corresponding LEDs is emitted through the mating cavity and the mating hole to the corresponding mating ring for viewable identification.

18. The electrical connector as claimed in claim 17, wherein the housing includes a front main body and a rear holder, and the mating cavity is formed in the main body while each of said contacts is retained by the holder.

19. The electrical connector as claimed in claim 17, wherein said LEDs have corresponding positive legs and negative legs both located around a center area of the printed circuit board in a transverse direction perpendicular to said front-to-back direction.

20. The electrical connector as claimed in claim 19, wherein the positive leg and the negative leg of the same LED are spaced from each other in a vertical direction perpendicular to both said front-to-back direction and said transverse direction.

* * * * *